United States Patent [19]

Scobie et al.

[11] Patent Number: 5,054,374

[45] Date of Patent: Oct. 8, 1991

[54] ROTARY ACTUATOR

[75] Inventors: William B. Scobie, Houston; Robert A. Frenzel, Waller, both of Tex.

[73] Assignee: Keystone International Holdings Corp., Houston, Tex.

[21] Appl. No.: 624,341

[22] Filed: Dec. 7, 1990

Related U.S. Application Data

[63] Continuation-in-part of Ser. No. 452,207, Sep. 18, 1989, Pat. No. 5,007,330.

[51] Int. Cl.[5] ..... F01C 9/00

[52] U.S. Cl. ..... 92/120; 92/183; 277/27; 277/174; 277/177

[58] Field of Search ..... 92/120, 182, 183, 184, 92/185, 247, 177; 277/27, 173, 174, 177

[56] References Cited

U.S. PATENT DOCUMENTS

| | | | |
|---|---|---|---|
| 374,968 | 12/1887 | Kadel | 92/120 |
| 1,234,972 | 3/1916 | Trist | 92/247 |
| 3,426,655 | 2/1969 | Rumsey | 92/183 |
| 3,446,120 | 5/1969 | Sneen | 92/120 |
| 4,466,624 | 8/1984 | Panigati | 277/27 |
| 4,711,153 | 12/1987 | Bulman | 277/27 |

FOREIGN PATENT DOCUMENTS

| | | | |
|---|---|---|---|
| 129151 | 9/1948 | Australia | 92/183 |
| 503122 | 5/1954 | Canada | 92/120 |

*Primary Examiner*—Edward K. Look

*Assistant Examiner*—Thomas Denion

*Attorney, Agent, or Firm*—Browning, Bushman, Anderson & Brookhart

[57] ABSTRACT

A rotary actuator defining a first arcuate chamber and a second chamber, the housing having an inwardly projecting, peripherally extending rib which defines an aperture in open communication with the arcuate chamber, a peripherally extending groove being formed in the rib in surrounding relationship to the aperture, the groove having first and second peripherally extending spaced side surfaces, an arcuate shaped piston being disposed in the housing for reciprocable movement in the arcuate chamber, a shaft rotatably journaled in the housing and connected to the piston and being rotatable in response to movement of the piston, a floating seal disposed in the groove for effecting sealing between the piston and the housing, the seal being in sealing engagement with the first and second side surfaces forming the groove, a fluid pressure inlet to introduce fluid pressure into at least one of the arcuate chamber or the second chamber to provide a pressurized chamber and, effect movement of the piston in a first direction, a return system to effect movement of the piston in an opposite, second direction, the housing being provided with a passageway to transfer pressure from the pressurized chamber to the groove outwardly of the seal such that fluid pressure from the pressurized chamber acts to urge the seal inwardly into sealing engagement with the piston and the housing.

9 Claims, 2 Drawing Sheets

FIG. 1
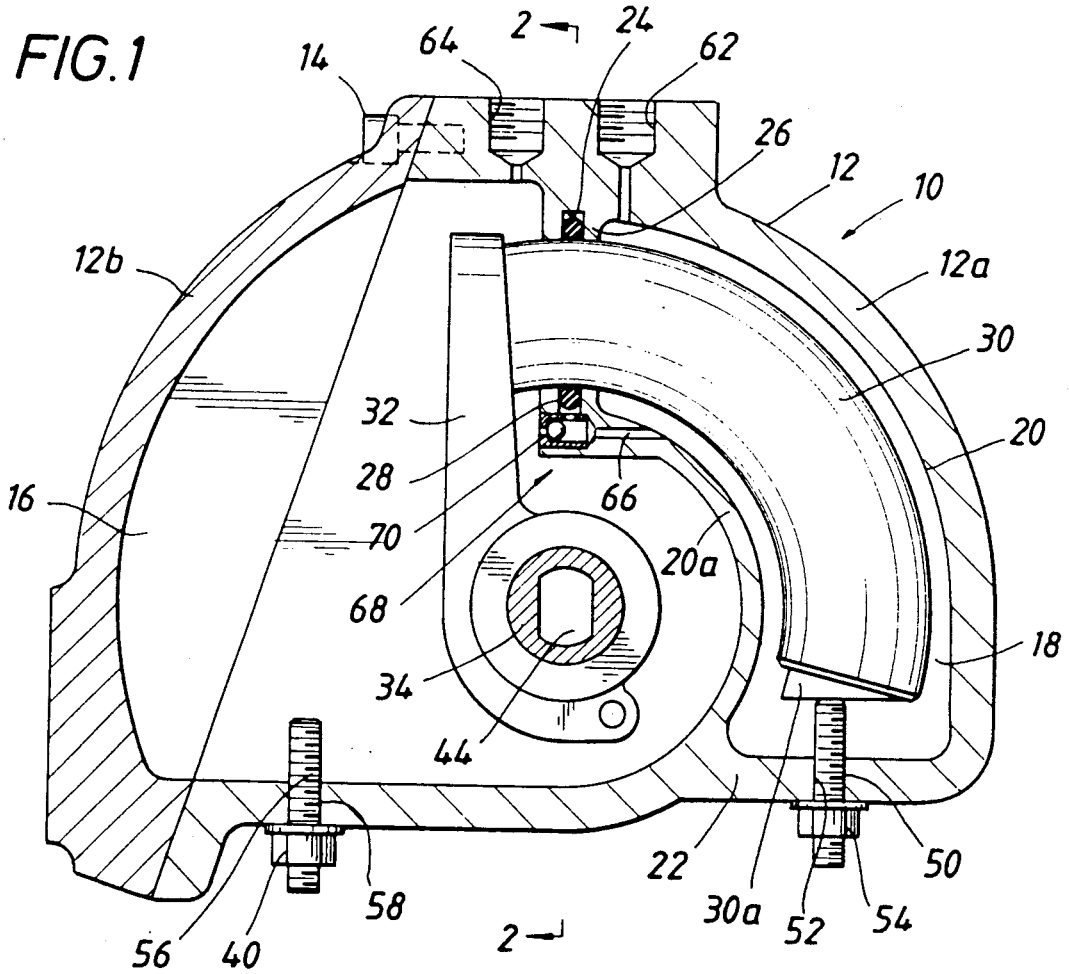
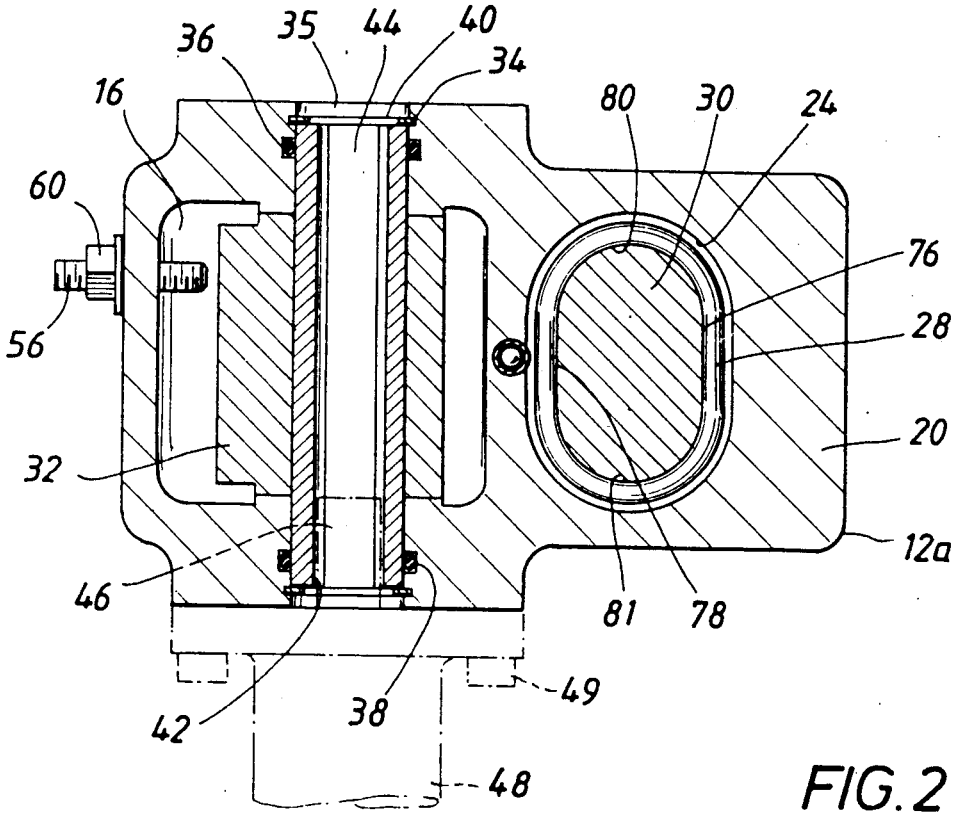
FIG. 2

FIG. 3
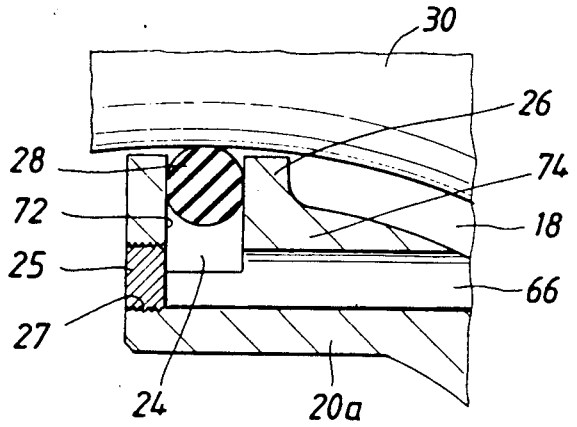
FIG. 4
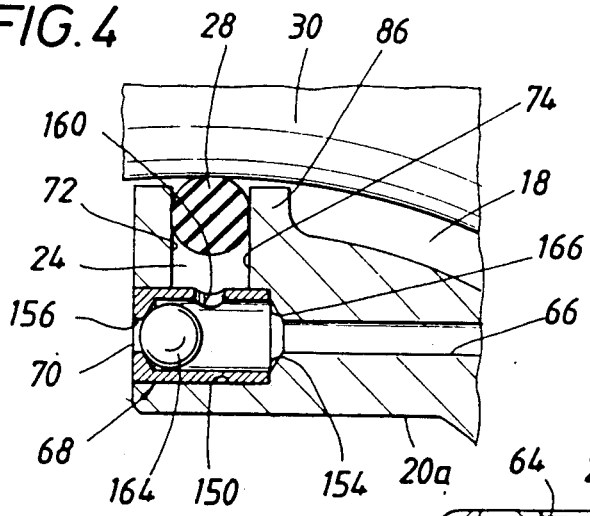
FIG. 5
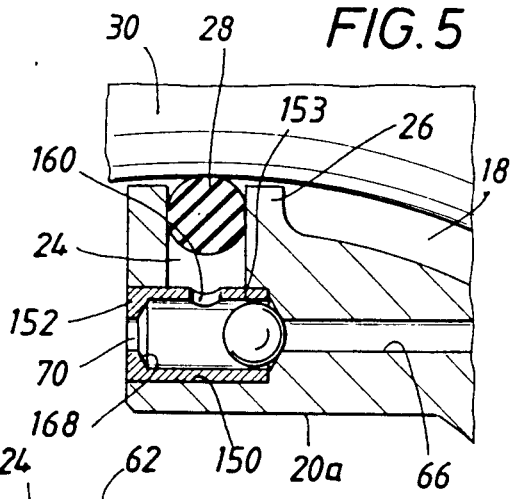
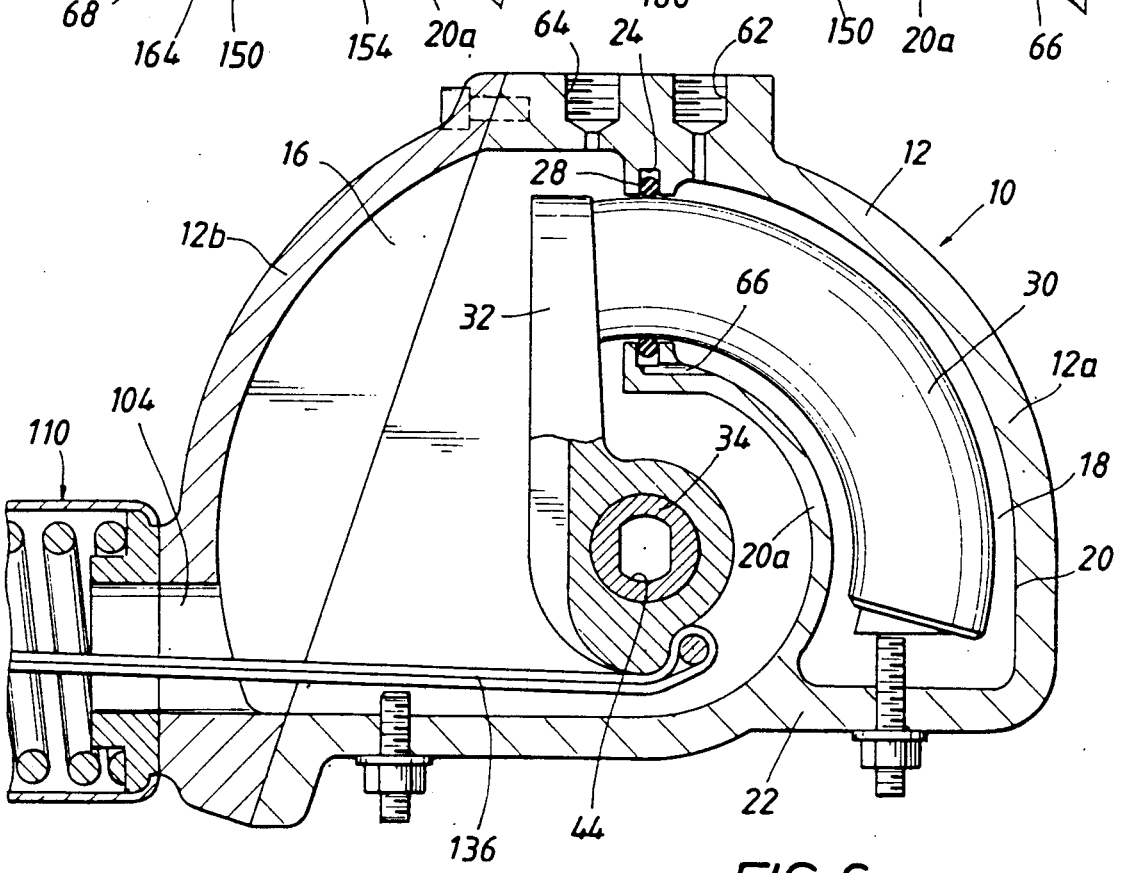
FIG. 6

ROTARY ACTUATOR

RELATED APPLICATION

This is a continuation-in-part of application Ser. No. 452,207, filed Sept. 18, 1989, now U.S. Pat. No. 5,007,330 filed Sept. 18, 1989, for a ROTARY ACTUATOR AND SEAL ASSEMBLY FOR USE THEREIN.

BACKGROUND OF THE INVENTION

1. Field of the Invention

The present invention relates to actuators. More particularly, the present invention relates to rotary actuators of the type which produce rotary motion of a shaft by means of a piston oscillating in a generally arcuate chamber.

2. Description of the Background

Rotary actuators are used in a variety of applications where it is desired to effect movement of a rotary fashion about a center point. For example, such actuators can be used to open and close valves, turns switches, operate steering mechanisms, etc. The actuator may be of the double-acting type wherein fluid, either hydraulic or pneumatic, is used to displace the piston in an oscillating manner in an arcuate chamber to hence effect rotation of a shaft in a clockwise or counterclockwise direction, depending upon movement of the attached piston. Alternatively, rotary actuators can be of the single-acting type wherein the fluid pressure is used to displace the piston and hence effect rotation of the shaft in one direction while rotation of the shaft in the other direction is accomplished by mechanical means, such as a spring return which, upon release of the pressure acting on the piston, automatically returns the piston to its initial position. In the rotary actuator described in U.S. patent application Ser. No. 452,207, incorporated herein by reference for all purposes, and in the preferred embodiment disclosed therein, the piston is of a type which has a generally elliptical, cross-sectional configuration. The use of a piston having that particular shape of cross section results in greater piston area than can be achieved with a piston having a circular cross section and thereby results in a corresponding increase in torque. At the same time, the overall diameter and "foot print" of the actuator is not increased. Moreover, the elliptical or oval design is clearly preferable to a rectangular design because of the difficulty in attempting to effect a fluid-tight seal between a piston having such a cross section and the housing in which the piston moves. Although there are many advantages to using a piston with a generally elliptical or obround, cross-sectional configuration, problems can arise in sealing around the periphery of the piston. It is known that in rotary actuator, as the piston oscillates in the housing, there is a tendency for the piston to undergo deflection making it difficult for the floating seal to maintain sealing engagement with the piston. In particular, in the case of pistons having obround or oval cross-sectional configurations, the seal deflection is not uniform but is more accentuated at the elongated sides of the piston with the result that the seal has a tendency to pull away from the elongate sides permitting leakage of the fluid pressure past the piston.

In an attempt to overcome that problem, and as disclosed in application Ser. No. 452,207, a unique seal assembly was used which included a generally flexible, taut band in surrounding relationship with the seal ring, the band serving to prevent outward bowing of the seal ring away from the elongate sides of the piston.

SUMMARY OF THE INVENTION

It is therefore an object of the present invention to provide an improved rotary actuator of the double-acting type.

Yet another object of the present invention is to provide an improved rotary actuator of the single-acting type.

Yet a further object of the present invention is to provide a rotary actuator which utilizes an energized seal to minimize leaking between the piston and the floating seal ring carried by the actuator housing.

The above and other objects of the present invention will become apparent from the drawings, the description given herein and the appended claims.

The rotary actuator of the present invention includes a housing which defines a first arcuate chamber and a second chamber, the housing further defining an inwardly projecting, peripherally extending rib, the rib defining an aperture in open communication with the arcuate chamber. A peripherally extending groove is formed in the rib in surrounding relationship to the aperture, the groove having first and second peripherally extending, spaced side surfaces or walls. An arcuate-shaped piston is the housing for reciprocable movement into and out of the arcuate chamber. A shaft is rotatably journaled in the housing and connected to the piston, the shaft being roatated in response to movement of the piston. A floating seal is disposed in the groove for effecting sealing between the piston and the housing, the seal being in sealing engagement with the first and second side surfaces of the groove and serving to isolate said first and second chambers from one another. Means are provided to introduce fluid pressure into the one of the arcuate chamber or second chamber to provide a pressurized chamber and effect movement of the piston in a first direction and there are also means to effect movement of the piston in an opposite, second direction. The housing further includes a means to transfer pressure from the pressurized chamber to the groove outwardly of the seal such that fluid pressure from the pressurized chamber acts to urge or energize the seal into sealing engagement with the piston.

BRIEF DESCRIPTION OF THE DRAWINGS

FIG. 1 is a top view, partly in section, of one embodiment of the actuator of the present invention showing the piston in the first position.

FIG. 2 is an elevational view, partly in section, and taken along the lines 2—2 of FIG. 1.

FIG. 3 is an enlarged, fragmentary view of a means to energize or urge the seal into sealing engagement with the piston in the case where the rotary actuator is of the single-acting type.

FIG. 4 is an enlarged, fragmentary view of a means to energize the seal ring in a rotary actuator of the double-acting type wherein pressure is being applied in the arcuate chamber.

FIG. 5 is a view similar to FIG. 4 showing a means to energize the seal ring when the fluid pressure is being applied in the second chamber.

FIG. 6 is a view similar to FIG. 1 showing a single-acting actuator employing a spring return.

Description of the Preferred Embodiments

Referring first to FIGS. 1 and 2, the rotary actuator, shown generally as 10, includes a housing 12 formed of first and second sections 12*a* and 12*b*, respectively. As shown, sections 12*a* and 12*b* are monolithic and are connected together by means of bolts, such as bolt 14. Although not shown, suitable gasketing can be provided between sections 12*a* and 12*b* to provide fluid-tight engagement. When assembled, sections 12*a* and 12*b* cooperate to form an internal chamber 16, while section 12*a* forms an arcuate chamber 18 which is completely contained with section 12*a*. As can be seen, chamber 18 is in the shape of a toroidal arc segment having a generally oval or elliptical cross section (see FIG. 2) formed by a wall 20 having an inwardly extending wing portion 20*a*, walls 20, 20*a* combining with an end wall 22 to form arcuate chamber 18. A peripheral or circumferential groove 24 is formed in a peripherally extending, radially inwardly projecting rib 26 which projects inwardly of walls 20, 20*a*, a floating seal ring 28 being disposed in groove 24. The seal ring 28, which can be an elastomeric member similar to an O-ring, effectively isolates chamber 18 from chamber 16 and is in sealing engagement with housing 12 and piston 30 disposed in chamber 18.

Piston 30 is connected, and generally, though not necessarily, monolithically formed with, a link member or arm 32 which is rigidly affixed, e.g. by keying, to a shaft 34 rotatably journaled in housing 12 whereby movement of piston 30 is transmitted via arm 32 to shaft 34 to effect rotation of shaft 34 about its axis. As best seen with reference to FIG. 2, shaft 34 is generally hollow and is journaled in a throughbore 35 in housing 12, sealing being accomplished by means of O-rings 36 and 38, shaft 34 being retained in housing 12 by means of snap rings 40 and 42. As shown, shaft 34 is provided with a central bore 44 which is of double-D configuration whereby shaft 34 can be attached to a driven member, such as a valve stem shown in phantom as 46, stem 46 protruding from the neck 48 (shown in phantom) of a valve such as a butterfly valve secured to actuator 10 by means of bolts (shown in phantom as 49). Accordingly, rotation of shaft 34 will result in rotation of driven stem or shaft 46.

Piston 30 is provided with a projecting nose portion 30*a*. Extending into arcuate chamber 18 is an adjustable stop 50, stop 50 being threadedly received in a threaded bore 52 in end wall 22 and having a lock nut 54 to maintain stop 52 at a predetermined location. Stop 50 cooperates with nose portion 30*a* of piston 30 to limit movement of piston 30 into arcuate chamber 18. There is also provided a second stop 56 which is threadedly received in a threaded bore 58 in end wall 22 and is likewise provided with a lock nut 60 to set stop 56 at a predetermined location. As best seen with reference to FIG. 1, stop 56 serves to limit movement of piston 30 in chamber 16, such limited movement being accomplished by abutment of arm 32 with stop 56 when piston 13 is rotated 90° from the position shown in FIG. 1.

The actuator shown in FIGS. 1 and 2 is of the double-acting type and, accordingly, is provided with means to effect oscillating movement of piston 30 in both the clockwise and counterclockwise directions by means of fluid pressure, i.e. piston 30 is moved from chamber 18 to chamber 16 and vice versa. To this end, housing 12 is provided with a first fluid inlet port 62 which is in open communication with arcuate chamber 18 and which provides a means to introduce a hydraulic or pneumatic fluid into arcuate chamber 18 whereby piston 30 will be forced out of chamber 18 and into chamber 16. Housing 12 also has a second fluid inlet port 64 which is in open communication with chamber 16 by which a pneumatic or hydraulic fluid can be introduced in chamber 16 to act upon piston arm 32 and piston 30 and effect movement of piston 30 out of chamber 16 into chamber 18. It is understood that either of chambers 16 and 18 is selectively, alternately pressurized, the other chamber being selectively alternately depressurized to permit the movement of piston 30 as described. Accordingly, oscillating or reciprocating movement of piston 30 can be effected with a corresponding clockwise and counterclockwise 90° rotation of shaft 34.

Wing wall 20*a* of housing 12 is provided with a passageway 66, passageway 66 providing open communication between chamber 18 and groove 24 radially outwardly of seal 28, i.e. behind seal 28. As described more fully hereafter, a check valve assembly, shown generally as 68, is disposed in a portion of wing wall 20*a* adjacent rib 26. As will be seen, seal assembly 68 provides a second passageway 70 which provides open communication between chamber 16 and groove 24 radially outwardly of seal 28.

Referring now to FIG. 6, there is shown an embodiment of the actuator wherein the actuator is of the single-acting type equipped with a spring return. The construction of actuator 10 shown in FIG. 6 is identical to that shown in FIGS. 1 and 2 with the exception that housing section 12*b* is provided with a hole 104 extending therethrough. Hole 104 serves as an aperture for a strap 136 forming part of a spring return assembly shown generally as 110. The structure and operation of the spring return 110 is fully described in co-pending application Ser. No. 452,207, incorporated herein by reference for all purposes. Suffice it to say that spring assembly 110 serves to bias piston 30 into the position shown in FIG. 6, while fluid pressure introduced in chamber 18 serves to force piston 30 into chamber 16 against the force exerted by the spring assembly 110.

With reference to FIG. 2, it can be seen that the cross-sectional configuration of piston 30 (in both the case of the actuators shown in FIGS. 1 and 6) is shown as generally elliptical, oval or what is referred to as obround (it being appreciated that the piston can be circular or have numerous other cross-sectional configurations). Specifically, it can be seen that the symmetrical cross section of piston 30 is defined by first and second side surfaces 76 and 78, respectively, side surfaces 76 and 78 having spaced, parallel side portions, side surfaces 76 and 78 being adjoined to end surfaces 80 and 82, the greatest distance between side surfaces 76 and 78 being less than the greatest distance between end surfaces 80 and 82. As can be seen, while the cross section of piston 30 is generally elliptical, it varies from a true ellipse by virtue of the fact that side surfaces 76, 78 are substantially straight and parallel to one another. Seal ring 24 which, as noted, can be made as a conventional O-ring and stretched to accommodate the profile of piston 30 is in surrounding, sealing engagement with piston 30.

It is well known that in rotary actuators of the type under consideration, under any substantial pressure, the generally arcuate piston will undergo flexing. The direction of force exerted on the piston by fluid pressure, as, for example, piston 30 in chamber 18, is normally against the piston face and perpendicular to the axis of the piston arm, i.e. arm 32. Floating seal 28 provides a simple and effective means to accommodate piston flexing and manufacturing tolerances and still ensure sealing between piston 30 and housing 12. To this end, groove 24, which is formed by side walls 72 and 74, has a depth (See FIGS. 3–5) which allows seal ring 28 to float thus ensuring that seal ring 28 remains in sealing engagement with piston 30. In this regard, it should be observed that when seal ring 28 is received in groove 24, seal ring 28 is sized relative to groove 24 such that it is in sealing engagement with side walls 72 and 74 of groove 24. Hence, seal ring 28 is in effective, fluid-tight sealing engagement with piston 30 and housing 12.

As noted above, due to the flexing of piston 30 under the action of pressure, seal ring 28 has to move or float to stay in sealing engagement with piston 30. In the case where piston 30 has an obround, oval or elliptical cross-sectional shape, such as shown, there is a tendency for the portions of seal ring 28 which engage the side surfaces 76 and 78, i.e. the elongate sides, to bow or flex away from piston 30 in response to pressure acting on the seal ring and to a lesser extent flexing of the piston 30, i.e. the seal ring does not faithfully follow the piston 30 against the elongate sides. The present invention solves the problem of seal/piston disengagement regardless of whether the actuator 10 is of the double-acting type shown in FIG. 1 or the single-acting type shown in FIG. 6.

Referring now to FIGS. 4 and 5, the structure and operation of the check valve assembly 68 will be described in greater detail. Passageway 66 is in open communication with and concentric to a counterbore 150 formed in wall 20*a*. Retained in the counterbore 150 is a generally hollow, cylindrical member 152, cylindrical member 152 defining a cylindrical chamber 153 and having a first port 154, a second port 156 and a third port 160, all of which open into chamber 153. First port 154 is in open communication with passageway 66 while second port 156 is defined by second passageway 70 leading to the chamber 153 in cylindrical member 152, passageway 70 providing open communication between chamber 16 and chamber 153. Third port 160 provides open communication between groove 24 and chamber 153. Disposed in cylindrical chamber 153 is a spherical valve element or ball 164. A seating surface 166 is formed by a counterbore concentric to passageway 66, while a second seating surface 168 is formed interiorly of cylindrical member 152. Seating surfaces 166 and 168 provide surfaces for spherical valve element 164 to sealingly seat against for a purpose hereafter described.

In the position shown in FIG. 4, with spherical valve element 164 engaging seating surface 168, open communication between groove 24 and passageway 162 is closed. In this position, fluid pressure in chamber 18, the pressurized chamber, will act to move piston 30 out of chamber 18 into chamber 16 and simultaneously enter chamber 153 and via port 160 will enter groove 24 to exert an inwardly acting, peripherally extending uniform pressure against seal ring 28 ensuring that seal ring 28 follows any flexing of piston 30. However, the fluid pressure acts to prevent the seal ring 28 from bowing out of sealing engagement with the elongate sides of piston 30. At the same time, the fluid pressure from chamber 18 cannot escape into chamber 16 since the fluid pressure from chamber 18 also acts against ball 164 to force it into sealing engagement with seating surface 168 and prevent any escape of fluid pressure into chamber 16 via passageway 162. When it is now desired to oscillate piston 30 back into chamber 18, fluid pressure would then be introduced via port 64, into chamber 16, chamber 18 being depressurized. In this case, valve element 164 will now be moved to the position shown in FIG. 5, and forced by the pressure from chamber 16 into sealing engagement with seating surface 166. Fluid pressure from chamber 16, now the pressurized chamber, will also enter cylindrical chamber 153 via passageway 162 and then into groove 24 via port 160, the fluid pressure entering groove 24 inwardly of seal ring 28 and exerting an inwardly directed, peripherally extending pressure against seal ring 28 forcing seal ring 28 into tight, uniform sealing engagement with piston 30 and preventing any outward bowing of the seal ring 28 away from the elongate sides of piston 30.

In effect, check valve assembly 68 is operatively disposed between passageway 66 and passageway 170 to selectively permit seal ring 28 to be energized either by the pressure in chamber 18 or the pressure in chamber 16, depending upon whether piston 30 is being moved from chamber 16 to chamber 18 or vice versa. At the same time, however, fluid pressure is prevented from escaping from chamber 16 to chamber 18 or vice versa by virtue of check valve assembly 68.

Referring now to FIG. 3, there is shown the embodiment of the present invention wherein when the rotary actuator is of the single-acting type, as shown in FIG. 6, i.e. a spring, return or some other mechanical means is used to effect movement of the piston in at least one direction, the seal ring 28 can also be energized. As seen, groove 24 is in open communication with passageway 66 which, as described above, is in open communication with arcuate chamber 18. A threaded plug 25 is sealingly received in a threaded bore 27 in rib 26 and acts to prevent escape of fluid from chamber 18 to chamber 16. Also, bore 27 permits passageway 66 to be easily drilled in wall 20*a* and rib 26. Accordingly, pressure in arcuate chamber 18 can act against seal ring 28, in the manner described above with respect to the embodiment shown in FIGS. 1, 4 and 5, passageway 66 communicating with groove 24 outwardly of seal ring 28. As shown, seal ring 28, which can be of the conventional O-ring type construction, is sized so as to sealingly engage side walls 72 and 74. Additionally, as described above, the depth of groove 24 is such as to permit seal ring 28 to move or float in response to any flexing of piston 30 as it oscillates in and out of chamber 18. Since in this case only one pressurized chamber is involved, i.e. chamber 18, there is no need for the check valve assembly 68.

Thus, it can be seen that the rotary actuator of the present invention provides a floating seal assembly wherein the flexible seal ring can be maintained in uniform, sealing engagement with the piston at all times even though the piston may undergo flexing. The pressure energization of the seal eliminates the necessity for any reinforcing or back-up rings around the outer periphery of the seal ring, such back-up or reinforcing rings usually being necessary to permit flexing or bowing of the seal ring away from the piston, particularly in cases where the piston has a cross-sectional configuration which is generally oval, elliptical or obround in shape. In effect, a simple O-ring can be employed, the O-ring being maintained in fluid-tight engagement with the piston and the housing. In the latter regard, it should be observed that as fluid pressure acts on the outer periphery of the seal ring, compression of the seal ring toward the piston will result in even tighter engagement of the seal ring with the walls of the groove, the overall effect being that the fluid energization effects not only a tighter seal with the piston but with the housing as well.

The foregoing represents only one preferred embodiment of the invention, and it will be understood that numerous modifications may suggest themselves to those skilled in the art. Accordingly, it is intended that the scope of the present invention be limited only by the claims which follow.

What is claimed is:

1. A rotary actuator comprising:

a housing defining a first arcuate chamber and a second chamber, said housing further defining an inwardly projecting, peripherally extending rib, said rib defining an aperture in open communication with said arcuate chamber, a peripherally extending groove being formed in said rib in surrounding relationship to said aperture, said groove having first and second peripherally extending; spaced, side surfaces;

an arcuate-shaped piston disposed in said housing for reciprocable movement in said arcuate chamber;

a shaft rotatably journaled in said housing and connected to said piston, said shaft being rotated in response to movement of said piston;

a floating seal disposed in said groove for effecting sealing between said piston and said housing, said seal being in sealing engagement with said first and second side surfaces, said seal serving to isolate said first chamber from said second chamber;

means to introduce fluid pressure into at least one of said arcuate chamber or said second chamber to provide at least one pressurized chamber and to effect movement of said piston in a first direction;

means to effect movement of said piston in an opposite, second direction; and means to transfer pressure from said pressurized chamber to said groove outwardly of said seal whereby fluid pressure from said pressurized chamber acts to urge said seal into sealing engagement with said piston.

2. The actuator of claim 1 wherein said second chamber is located on the side of said seal opposite said first arcuate chamber and said means to effect movement of said piston in an opposite, second direction comprises means to introduce fluid pressure into said second chamber.

3. The actuator of claim 2 wherein said means to transfer pressure from said pressurized chamber includes a first passageway providing open communication between said groove and said arcuate chamber.

4. The actuator of claim 3 including a second passageway, said second passageway providing open communication between said groove inwardly of said seal and said second chamber, a check valve operatively disposed between said first and second passageways, whereby when fluid pressure is in said arcuate chamber to effect movement of said piston in said first direction, said check valve acts to seal off said second passageway from open communication with said groove and when said fluid pressure is in said second chamber to effect movement of said piston in said opposite, second direction, said check valve serves to seal off open communication between said first passageway and said groove.

5. The actuator of claim 4 wherein said check valve comprises a cylindrical body defining a cylindrical chamber and having first, second and third ports opening into said cylindrical chamber, said first port being in open communication with said first passageway, said second port being defined by said second passageway, said third port being in open communication with said groove, and a spherical valve element movably disposed in said cylindrical chamber, said valve element acting to seal off said second port when said fluid pressure is in said arcuate chamber to effect movement of said piston in said first direction, said spherical valve element sealing off said first port when said fluid pressure is in said second chamber to effect movement of said piston in said opposite, second direction.

6. The actuator of claim 1 wherein said means to effect movement of said piston in an opposite, second direction comprises a spring return and said means to transfer pressure from said pressurized chamber includes a passageway providing open communication between said groove and said first arcuate chamber.

7. The actuator of claim 1 wherein said housing includes a first monolithic portion and a second portion, said first arcuate chamber being completely contained within said first portion, said second portion being adjacent to said first portion such that said second portion faces said aperture defined by said rib.

8. The actuator of claim 1 wherein said piston is generally elliptical in cross-sectional configuration.

9. The actuator of claim 8 wherein said piston has a symmetrical, cross-sectional configuration defined by opposed side surfaces and opposed, arcuate end surfaces of said piston, said opposed side surfaces being interconnected by said first and second arcuate end surfaces to form a generally elliptical cross-sectional configuration, the greatest distance between said side surfaces being less than the greatest distance between said end surfaces, said aperture having a generally elliptical cross-sectional configuration complementary to the cross-sectional configuration of said piston, said seal comprising a resilient ring, said piston being sealingly engaged by said ring.

* * * * *